United States Patent [19]

Norskau et al.

[11] Patent Number: 4,639,195

[45] Date of Patent: Jan. 27, 1987

[54] POWER CONTROL DEVICES FOR HYDROSTATIC PUMPS

[75] Inventors: Jurgen Norskau, Lohr; Rudolf Richter, Hosbach, both of Fed. Rep. of Germany

[73] Assignee: Linde Aktiengesellschaft, Wiesbaden, Fed. Rep. of Germany

[21] Appl. No.: 687,524

[22] Filed: Dec. 28, 1984

[30] Foreign Application Priority Data

Jan. 19, 1984 [DE] Fed. Rep. of Germany ..... 3401818

[51] Int. Cl.[4] ..... F04B 1/26

[52] U.S. Cl. ..... 417/216; 417/218; 417/222

[58] Field of Search ..... 417/212, 213, 216, 217, 417/218, 222; 91/506; 92/12.2

[56] References Cited

U.S. PATENT DOCUMENTS

| | | | |
|---|---|---|---|
| 3,407,738 | 10/1968 | Bosch | 417/218 |
| 3,554,671 | 1/1971 | Schlinke | 92/12.2 X |
| 3,669,570 | 6/1972 | Himmler | 417/222 |
| 3,694,108 | 9/1972 | Pensa | 91/506 |
| 3,958,496 | 5/1976 | Wallin | 91/506 |
| 4,077,744 | 3/1978 | Persa | 417/218 |
| 4,273,517 | 6/1981 | Heyl | 91/506 X |
| 4,544,330 | 10/1985 | Schniederjan | 417/218 |

FOREIGN PATENT DOCUMENTS

| | | | |
|---|---|---|---|
| 2942403 | 4/1981 | Fed. Rep. of Germany | 417/218 |
| 1530592 | 11/1978 | United Kingdom | 91/506 |

*Primary Examiner*—Louis J. Casaregola
*Assistant Examiner*—Paul F. Neils
*Attorney, Agent, or Firm*—Buell, Ziesenheim, Beck & Alstadt

[57] ABSTRACT

A power control device for an adjustable hydrostatic pump with a lever controlling a control valve piston and a pressure measuring piston loaded with feed pressure acting on said lever to control the pressure feed to a servo piston is provided wherein the pressure measuring piston loaded with feed pressure is mounted in a structural member slidable with the servo piston and slides lengthwise of the lever and the control valve piston is biased by resilient member toward the pressure measuring piston.

15 Claims, 3 Drawing Figures

POWER CONTROL DEVICES FOR HYDROSTATIC PUMPS

This invention relates to power control devices for hydrostatic pumps and particularly to a power control device for an adjustable hydrostatic pump, in which a force, dependent on the feed pressure of the pump, acts on a lever with a variable lever arm through a pressure measuring piston. In a familiar prior art device of this type, the pressure-measuring piston loaded with the feed pressure is capable of sliding in a cylinder attached in a fixed manner in the housing and the axis of rotation of the lever arm is located at the servo piston, in which the borehole for the control piston of the control valve and a second borehole parallel to the first one for the regulating spring are located (DE-OS No. 28 10 062). This arrangement necessitates an expensive servo piston. To be sure, an improved design is also known, in which the regulating spring is located in the control piston coaxial to its axis. This makes it possible to adjust the thrust screw and thus the pretension of the regulating spring from the outside after removing the operating cylinder cover (DE-OS No. 29 30 139). However, this also necessitates an expensive servo piston.

On the other hand, an arrangement is also known in which the lever is supported in a housing and a force-producing device is displaced along this lever, together with the servo piston, so that the lever arm, on which this force-producing device acts, varies with the position of the servo piston and thus with the setting of the pump. However, the pressure-measuring piston is located in the housing in this arrangement also.

The present invention provides a power regulator that can be readily mounted as an attachment to the control of a pump so that it is possible with only a little extra expense to provide the pump with or without a power regulator.

This problem is solved by locating the pressure measuring piston, which is loaded with feed pressure, in a structural component that is capable of sliding with the servo piston, supporting the regulating spring against the control piston of the control valve and supporting the axis of rotation of the lever directly or indirectly in a housing connected with the control mechanism containing the servo piston and in which the borehole for the control valve piston of the control valve is located and in which the regulating spring is supported directly or indirectly. Another advantage consists of the fact that it can be readily assured with this arrangement that the feed pressure-dependent force always acts at an adequate minimum distance from the axis of rotation of the lever.

Another essential feature consists in being able to design the regulator so that the power absorbed by an additional constant displacement pump, which is driven by the same primary energy source, is also taken into consideration of the regulator.

This problem is solved by providing an additional piston which is loaded by the feed pressure of the constant pump and which is installed so as to counteract the regulating spring so that the line of action of force runs at a constant distance from the axis of rotation of the lever. As a result of this design, the power absorbed by the constant pump is optimally taken into consideration. Through this implementation form, the power regulation of the adjustable pump always takes place correctly, corresponding to the product of pressure times stream equal to a constant, i.e., in the diagram it is regulated precisely along a hyperbola of constant power, independently of whether the constant pump delivers against pressure and the level of this pressure.

Determination of the position of the pressure-measuring piston with regard to the end face of the servo piston so that if the servo piston lies with its end face against a stop, the pressure-measuring piston has a quite well-defined position with respect to the axis of rotation of the lever, e.g., the action of force line of the pressure-measuring piston passes precisely through the axis of rotation (extreme position), is facilitated by providing that the structural component in which the cylinder carrying the pressure measuring piston is located can be fixed to the servo piston at different distances from its end face. The cylinder structure component is preferably provided with a threaded base screwed into a threaded hole of the servo piston and the threaded base is installed eccentrically on the cylinder structural component so that spacers of varying wall thickness can be inserted between the annular surface of the cylinder structural component surrounding the threaded base and the servo piston.

In the foregoing general description of this invention, we have set out certain objects, purposes and advantages of this invention. Other objects, purposes and advantages of this invention will be apparent from a consideration of the following description and the accompanying drawings in which.

Figure 1:
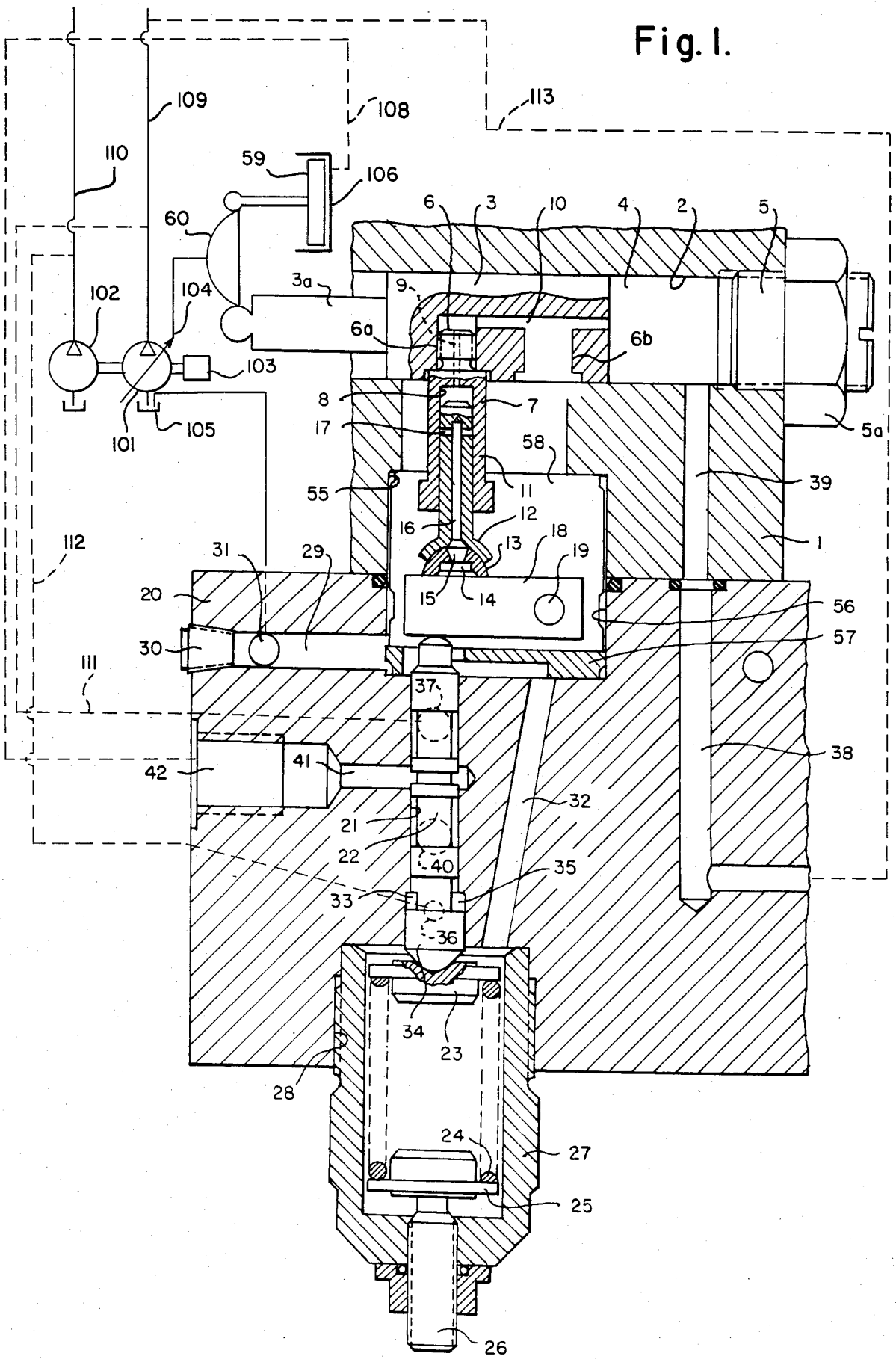
FIG. 1 is a section through a power regulator according to this invention.
Figure 2:
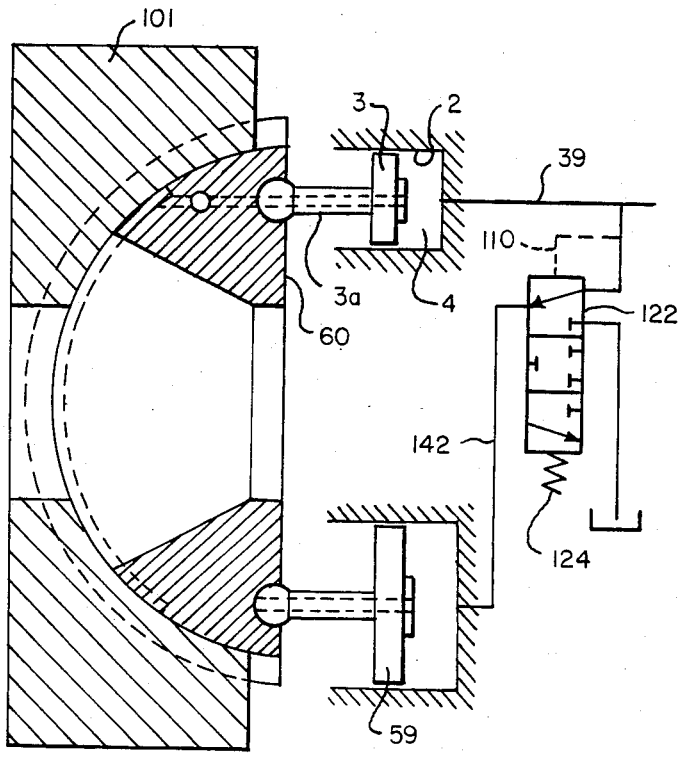
FIG. 2 shows a circuit diagram of an adjusting device for an axial piston pump of this invention.

In the housing 1 of the adjusting device, which is not shown in FIG. 1 and is only schematically outlined in FIG. 2, the operating cylinder 2 is provided. The small servo piston 3 is capable of sliding in it. It is connected with the final control element 104 of a variable displacement pump 101 driven by a primary energy source 103, such as a Diesel engine, by means of the servo piston rod 3*a* (in a manner shown in FIG. 2). As illustrated in FIG. 2, the servo piston rod 3*a* is connected with the rocker 60, which is connected on the other side with a second oppositely acting servo piston 59 of larger diameter, as such a system is depicted in FIG. 2. In this system the pressure chamber 4 in the operating cylinder 2 in front of the end face of the servo piston 3 is continuously loaded with the feed pressure of the pump. This pressure chamber 4 is closed off by a stopper 5, which in turn can be locked by means of a nut 5*a*, in which case the stopper 5 has a stop projection on its face.

A threaded fastening base 6 of a cylinder component 7 is screwed into a radial threaded borehole 6*b* of the servo piston 3. The threaded base 6 is eccentric with respect to the cylinder component 7 so that the position of the cylinder component 7 with respect to the end face of the servo piston 3, in which the cylinder component 7 is solidly screwed, can be varied by inserting shims of varying thickness. A cylindrical borehole 8 is provided in the cylinder component 7; it is connected through a borehole 9 in the threaded base 6 and a borehole 10 in the servo piston 3 with the pressure chamber 4. A pressure-measuring piston 11 is capable of sliding in the cylindrical borehole 8 and it lies, by means of a base part 12, against the slide shoe 13, whose outer surface is calotte-shaped and which has a pressure cushion recess 14 that is connected through a borehole 15 in the slide shoe 13 with the axial borehole 16 in the pressure-measuring piston 11, which in turn is connected with radial boreholes 17 that empty at the periphery of the pressure-measuring piston 11. The slide shoe lies against the lever 18, which is capable of pivoting around a bolt 19, which is supported in an intermediate component 57/58.

To prevent the slide shoe 13 under the base part 20 from falling out when the entire apparatus is being transported in the pressureless state, an annular groove can be provided in the axial borehole 16. A tubular rivet running through the recess 15, as used for connecting thin sheets, plastic plates or leather components together, is inserted into the annular groove so that the slide shoe 13 cannot be removed completely from the base part 12, but can move with respect to it or a wire hook can be provided for the same purpose. These possibilities are not shown in the drawing.

A borehole 21 is provided in the attachment 20. A control piston 22 is capable of sliding in it and it lies against the lower side of the lever 18 in the drawing with its upper face in the drawing. The spring plate 23 lies against the lower end of the component, of which the control piston 22 is a part. The regulating spring 24 is supported against this spring plate and on the other side it is supported against a spring plate 25, whose position can be adjusted by means of a setscrew. The pretension of the regulating spring 24 is adjusted by regulating the position of the spring plate 25. The threaded bolt 26 is screwed into a threaded borehole of the screw-on sleeve 27, which in turn is screwed into a thread 28 of the attachment 20.

The space in which the lever 18 is located is connected through a borehole 29, which is closed off by a stopper 30, with the borehole 31, which leads to a pressureless tank 105. This space in which the lever 18 is located is also connected through a borehole 32 with the space in which the regulating spring 24 is located, so that the latter space is connected with the pressureless tank 105.

A borehole 33, which has a larger diameter than the borehole 21, is connected coaxially to the borehole 21. The lower part 34 of the component, on which the control piston 22 is formed, has a larger diameter than the control piston 22, so that it is slid in a sealing manner into the borehole 33 of larger diameter. The overall component 22/34 is thus formed as a single stepped piston. The annular space in front of the end face of this stepped piston is connected through the borehole 36 lying behind the plane of the drawing through line 112 with the feed line of a constant pump 102, which is driven by the same primary energy source 103 as the adjustable pump, whose setting is determined by the position of the servo piston 3. In this case, the power absorbed by the said constant pump (102) is to be taken into account by the power regulator. Parallel to the borehole 36, there is a borehole 37 that is connected by line 111 with the feed line 109 of the pump 101 whose power is to be regulated. The borehole 38 is also connected with this feed line 109 through line 113 and in turn with the borehole 39, which empties into the pressure chamber 4. A borehole 40 is located between the boreholes 36 and 37, parallel to them, and it is connected with the borehole 31 in a manner not shown in the drawing. The borehole 41 is connected through the connection 42 and line 108 with the pressure chamber 106 in front of the large servo piston 59.

The mode of operation is as follows: the borehole 38 is continuously loaded with the feed pressure of the pump whose power is to be regulated, so that this pressure also prevails in the pressure chamber 4 through the borehole 39 and acts through the axial borehole 10 and the borehole 9 on the pressure chamber in front of the end face of the pressure-measuring piston 11. Thus, a force that is proportional to the feed pressure is continuously produced at the pressure-measuring piston 11. This force acts on the upper side of the lever 18 in the drawing. The lever arm, with which this force acts, is dependent on the setting of the servo piston 3 and thus the final control element of the pump to be regulated. If the latter lever arm is shifted to the left in the drawing, the stroke volume per revolution of the pump becomes greater and the active lever arm on the lever 18 also.

On the opposite side of the lever 18, i.e., on its lower side in the drawing, the force of the regulating spring 24 exerts its action. If the product of the force exerted by the pressure-measuring piston 11 times the lever arm exceeds the product of the force exerted by the regulating spring 24 times the assigned lever arm, the lever 18 is swung counterclockwise and shifts the control piston 22 downward in the drawing, so that the borehole 37 is connected with the borehole 41 and thus pressure medium is conveyed into the pressure chamber in front of the larger servo piston.

If the product of the force of the regulating spring 24 times the lever arm exceeds the product of the force of the pressure-measuring piston 11 times the assigned lever arm, the control piston 22 is shifted upward in the drawing, with the result that the borehole 41 is connected with the borehole 40 and thus pressure medium is released out of the pressure chamber in front of the large servo piston to the pressureless tank.

A borehole 55 is provided in the housing 1 of the control device and a borehole 56 is provided in the attachment 20 that serves as a housing for a substantial part of the power regulator. For centering, i.e., so that the two boreholes 55 and 56 always lie coaxially to each other, an externally cylindrical body is inserted as an intermediate component in these two boreholes. This intermediate component has a bottom plate 57 and a slit in the upper zone in the drawing, such that at the side of the slit two lateral components 58 remain, between which the lever 18 is located, in which case the parts 7, 11, 12 and 13 project into this slit. The bolt 19 is supported in the lateral components 58. It can be seen in the circuit diagram according to FIG. 2 that a rocker 60 is supported in the housing bottom 101 and it is connected with the two servo pistons 3 and 59, of which the servo piston 3 has the smaller diameter and the servo piston 59 has the larger diameter, but acts on the rocker 60 on the other side of the swing axis than the servo piston 3. The valve 122 corresponds in its action diagramatically to that of the servo valve spool 22, i.e., the slider of this valve is loaded on one side by the pressure in the feed line through the lines 39 and 110 and is supported on the other side against the spring 124, which corresponds diagramatically to the regulating spring 24 in the design according to FIG. 1. Accordingly, the line 142 also corresponds diagramatically to the line 42 according to FIG. 1.

Figure 3:
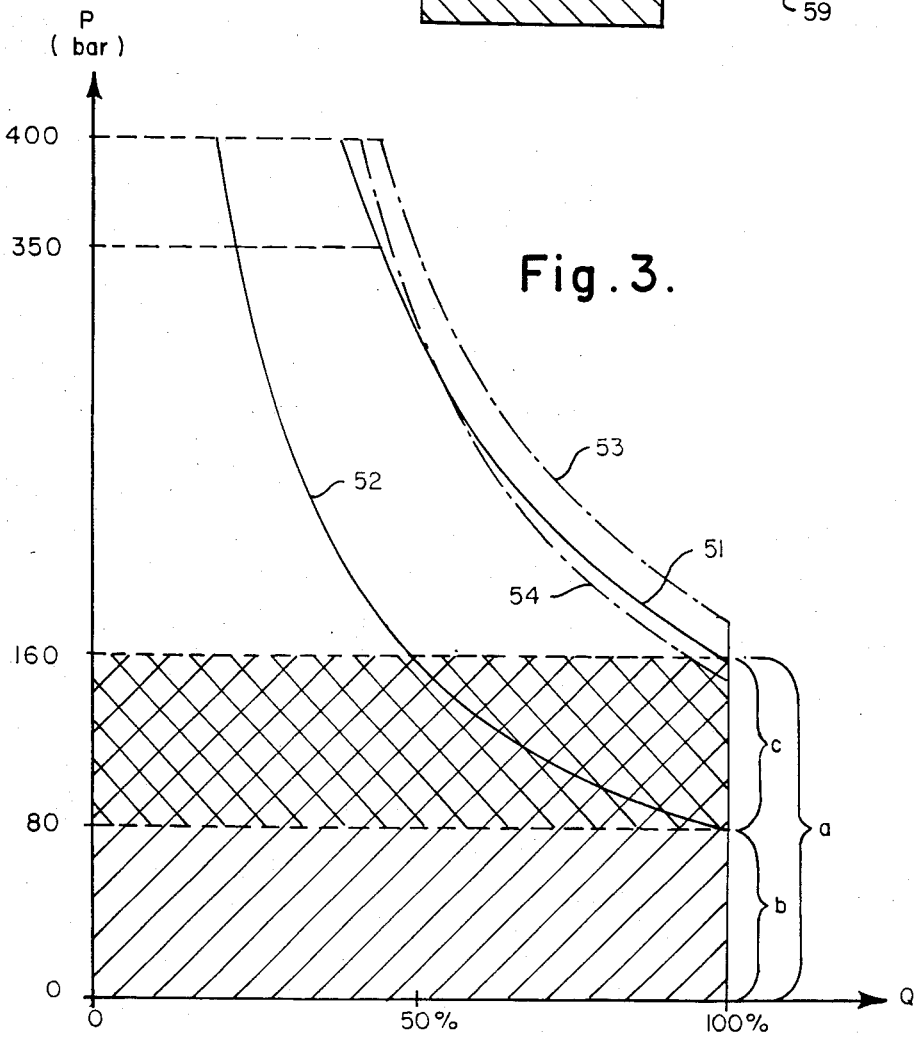
FIG. 3 shows a power regulating diagram for a power regulator according to FIG. 1.

In the diagram shown in FIG. 3, the feed pressure of the adjustable pump is plotted over its feed stream, i.e., assuming that the pump is driven with a constant r.p.m., the feed pressure is plotted over the stroke volume per revolution. The power hyperbola, along with the adjustable pump is regulated, so long as the constant pump driven by the same primary energy source absorbs no power, i.e., no pressure prevails in the feed line of this constant pump, is designated by 51 in this diagram. However, if a pressure of 300 bar, for example, prevails in the feed line of this constant pump, the adjustable pump is regulated according to the hyperbola 52, because only a lesser power is available in this state for the drive of the adjustable pump, since a portion of the power is consumed in driving the constant pump. While if the constant pump absorbs no power, the adjustable pump is supplied with a power from the primary energy source, a power that corresponds overall to the rectangle hatched in the drawing from the bottom left to the top right and designated by the brace a, i.e., corresponds to the sum of the rectangles designed by the braces b and c; if the constant pump delivers against a pressure of 300 bar, the adjustable pump has at its disposal only a power that corresponds to the narrower rectangle hatched from the bottom left to the top right and designated by the brace b, while the opposite rectangle hatched from the top left to the bottom right (and additionally hatched in the other direction with respect to the brace a) and designated by the brace c corresponds to the power absorbed by the constant pump. Consequently, the power hyperbola 52 begins at the corner of the rectangle designed by the brace b. In the case shown, the maximum feed volume per revolution of the adjustable pump is 3.75 times the displacement volume per revolution of the constant pump, such that the adjustable pump absorbs the same power when set at the maximum displacement volume at 80 bar as the constant pump at 300 bar, corresponding to the ratio 3.75:1.

The dash-dot power hyperbola 54 is the power hyperbola along which the regulation is carried out if the component 7 with the cylinder 8, in which the pressure-measuring piston 11 is capable of sliding, if fixed in a different position with respect to the servo piston 3, i.e., the active lever arm is modified.

The regulation is carried out along the power hyperbola 53, which is also shown as a dash-dot line, if the regulating spring 24 is adjusted by turning the threaded bolt 26 to a higher pretension and thus the power regulator to a higher power. By turning the threaded bolt 26 in the other direction, a lower pretension of the regulating spring 24 can be obtained and thus the power regulator can be adjusted to a lesser power.

The structural member, i.e. cylinder component 7 can be mounted along the length of the servo piston in different boreholes 6*b*.

In the foregoing specification we have set out certain preferred practices and embodiments of this invention, however, it may be understood that this invention may be otherwise embodied within the scope of the following claims.

We claim:

1. In a control device for an adjustable hydrostatic pump having a housing containing a servo piston acting on an adjusting member of the pump, a lever pivoted at one end and adjacent the other end bearing on a piston control valve that regulates the pressure loading on the servo piston, the improvement comprising pressure measuring piston loaded with feed pressure having one end slidably bearing against the lever between the pivot and said other end, said piston control valve acting on the lever opposite the pressure measuring piston, resilient means acting against the piston control valve opposite the lever biasing it toward the pressure measuring piston, a structural member fixed on the servo piston and movable therewith carrying said pressure measuring piston and a lever housing attached to said servo piston housing carrying a lever pivot support means for the lever and a borehole for the piston control valve and resilient means, a slide shoe located between the pressure measuring piston and lever and slides on said lever as the pressure measuring piston moves with the servo piston and wherein pressure fluid feed means is provided in the pressure measuring piston providing a pressure fluid cushion between the lever and slide shoe.

2. A control device as claimed in claim 1 wherein the resilient means is a spring.

3. A control device as claimed in claim 1 wherein the structural member is a cylinder fixed to the servo piston receiving pressure fluid through the servo piston acting on said pressure measuring piston.

4. A control device as claimed in claim 1 or 2 or 3 wherein the slide shoe is in the form of a calotte with a central recess and a borehole in the apex.

5. A control device as claimed in claim 1 or 2 or 3 wherein the structural member can be mounted on the servo piston at different points along the piston length.

6. A control device as claimed in claim 1 or 2 or 3 wherein a constant pressure pump and the adjustable hydrostatic pump are driven by a common power source and the piston control valve includes a piston area receiving pressure from said constant pressure pump counteracting to the resilient means so that the line of action of force runs at a constant distance from the axis of rotation of the lever on the pivot.

7. A control device as claimed in claim 6 wherein the ratio of the piston area receiving fluid from the constant pump to the piston area of the pressure measuring piston is at least equal to the ratio between the displacement volume per revolution of the constant pump and the maximum displacement volume per revolution of the adjustable pump.

8. In a control device for an adjustable hydrostatic pump having a housing containing a servo piston acting on an adjusting member of the pump, a lever pivoted at one end and adjacent the other end bearing on a piston control valve that regulates the pressure loading on the servo piston, the improvement comprising a pressure measuring piston loaded with feed pressure having one end slidably bearing against the lever between the pivot and said other end, said piston control valve acting on the lever opposite the pressure measuring piston, resilient means acting against the piston control valve opposite the lever biasing it toward the pressure measuring piston, a structural member fixed on the servo piston and movable therewith carrying said pressure measuring piston and a lever housing attached to said servo piston housing carrying a lever pivot support means for the lever and a borehole for the piston control valve and resilient means, a slide shoe located between the pressure measuring piston and lever and slides on said lever as the pressure measuring piston moves with the servo piston and wherein the slide shoe is in the form of a calotte with a central recess and a borehole in the apex.

9. A control device as claimed in claim 8 wherein the resilient means is a spring.

10. A control device as claimed in claim 8 wherein the structural member is a cylinder fixed to the servo piston receiving pressure fluid through the servo piston acting on said pressure measuring piston.

11. In a control device for an adjustable hydrostatic pump having a housing containing a servo piston acting on an adjusting member of the pump, a lever pivoted at one end and adjacent the other end bearing on a piston control valve that regulates the pressure loading on the servo piston, the improvement comprising a pressure measuring piston loaded with feed pressure having one end slidably bearing against the lever between the pivot and said other end, said piston control valve acting on the lever opposite the pressure measuring piston, resilient means acting against the piston control valve opposite the lever biasing it toward the piston and a lever housing attached to said servo piston housing carrying a lever pivot support means for the lever and a borehole for the piston control valve and said resilient means, said resilient means being a spring and said structural member being a cylinder fixed to the servo piston receiving pressure fluid through the servo piston acting on said pressure measuring piston and wherein the structural member can be mounted on the servo piston at different points along the piston length.

12. In a control device for an adjustable hydrostatic pump having a housing containing a servo piston acting on an adjusting member of the pump, a lever pivoted at one end and adjacent the other end bearing on a piston control valve that regulates the pressure loading on the servo piston, the improvement comprising a pressure measuring piston loaded with feed pressure having one end slidably bearing against the lever between the pivot and said other end, said piston control valve acting on the lever opposite the pressure measuring piston, resilient means acting against the piston control valve opposite the lever biasing it toward the piston and a lever housing attached to said servo piston housing carrying a lever pivot support means for the lever and a borehole for the piston control valve and said resilient means, said resilient means being a spring and said structural member being a cylinder fixed to the servo piston receiving pressure fluid through the servo piston acting on said pressure measuring piston, and wherein a slide shoe is located between the pressure measuring piston and lever and slides on said lever as the pressure measuring piston moves with the servo piston, and the structural member can be mounted on the servo piston at different points along the piston length.

13. In a control device for an adjustable hydrostatic pump having a housing containing a servo piston acting on an adjusting member of the pump, a lever pivoted at one end and adjacent the other end bearing on a piston control valve that regulates the pressure loading on the servo piston, the improvement comprising a pressure measuring piston loaded with feed pressure having one end slidably bearing against the lever between the pivot and said other end, said piston control valve acting on the lever opposite the pressure measuring piston, resilient means acting against the piston control valve opposite the lever biasing it toward the pressure measuring piston, a structural member fixed on the servo piston and movable therewith carrying said pressure measuring piston and a lever housing attached to said servo piston housing carrying a lever pivot support means for the lever and a borehole for the piston control valve and resilient means, said structural member being provided with a threaded end screwed into a threaded hole in the servo piston, and wherein the threaded base on the structural member is eccentrically formed on the end and spacers of varying wall thickness are insertable around the threaded end between the structural member and servo piston spacing the structural member at varying distances from the servo piston.

14. A control device as claimed in claim 13 wherein the resilient means is a spring.

15. A control device as claimed in claim 13 wherein the structural member is a cylinder fixed to the servo piston receiving pressure fluid through the servo piston acting on said pressure measuring piston.

* * * * *